US006423890B2

(12) United States Patent
Zbrzezny et al.

(10) Patent No.: US 6,423,890 B2
(45) Date of Patent: Jul. 23, 2002

(54) MULTIFACETED DRUMSTICK

(76) Inventors: Paul Zbrzezny, 3339 Sunnynook Dr., Los Angeles, CA (US) 90039; Robert Geyer, 125 N. Skyline Dr., Thousand Oaks, CA (US) 91360

( * ) Notice: Subject to any disclaimer, the term of this patent is extended or adjusted under 35 U.S.C. 154(b) by 0 days.

(21) Appl. No.: 09/186,820

(22) Filed: Nov. 5, 1998

(51) Int. Cl.[7] ..... G10D 13/02
(52) U.S. Cl. ..... 84/422.4
(58) Field of Search ..... 84/422.4; D17/99; 33/483, 484, 485, 494; 401/201, 221

(56) References Cited

U.S. PATENT DOCUMENTS

| | | | | | |
|---|---|---|---|---|---|
| 468,595 | A | * | 2/1892 | Bunch | 33/483 |
| 807,493 | A | * | 12/1905 | Phillips | 84/422.4 |
| 1,953,619 | A | * | 4/1934 | Ludwig | 84/422.4 |
| 3,150,555 | A | * | 9/1964 | Sage | 84/422.4 |
| 3,688,013 | A | | 8/1972 | Menard | 84/422 |
| 3,893,364 | A | * | 7/1975 | Harrison | 84/422.4 |
| 4,200,026 | A | * | 4/1980 | Phreaner | 84/422.4 |
| D264,977 | S | * | 6/1982 | Starks | D17/22 |
| D265,877 | S | * | 8/1982 | Hardy | D6/125 |
| 4,462,296 | A | | 7/1984 | Heiskell | 84/422 |
| D278,634 | S | * | 4/1985 | Anderson | D17/22 |
| 4,535,671 | A | | 8/1985 | Stromberg | 84/422 |
| D281,785 | S | * | 12/1985 | Balter et al. | D17/22 |
| 4,702,143 | A | | 10/1987 | Brochstein | 84/422 |
| 4,939,972 | A | * | 7/1990 | Falberg | 84/422.4 |
| 5,170,001 | A | | 12/1992 | Amendola | 84/422.4 |
| 5,447,088 | A | * | 9/1995 | Mester | 84/422.4 |
| D362,864 | S | | 10/1995 | Berardi | D17/22 |
| 5,503,056 | A | | 4/1996 | Evans | 84/422.4 |
| 5,581,031 | A | * | 12/1996 | Blankenship, Jr. | 84/453 |
| 5,696,339 | A | * | 12/1997 | Brennan | 84/422.4 |
| 5,929,356 | A | * | 7/1999 | Piland et al. | 84/422.4 |

FOREIGN PATENT DOCUMENTS

| | | | |
|---|---|---|---|
| GB | 1020750 | * | 2/1966 |

OTHER PUBLICATIONS www.unigrp200.com, www.drumspot.com,www.trueline-drumsticks.com, Feb. 27, 2002.*

* cited by examiner

*Primary Examiner*—Robert E. Nappi
*Assistant Examiner*—Kim Lockett
(74) *Attorney, Agent, or Firm*—S. H. Roddan, Esq.

(57) ABSTRACT

The invention is a grip for drumsticks. In the preferred embodiment, the invention consists of a cylindrical drumstick being lathed to have one or a plurality of external faceted surfaces in the longitudinal plane about its circumference. In an alternative embodiment the invention has an axial bore and a plurality of external facets in the longitudinal plane in its exterior structure, the axial bore receiving a cylindrical drumstick. In another embodiment the cylindrical drumstick may be retracted or extended within the axial bore of the invention. In another embodiment, the facets forming the gripping means may be knurled. It is irrelevant to the practice of the invention whether the structure is of a unitary, lathed form or a sheath-type, injection molded form. The facets may run the entire length of the drumstick, may be limited to the butt end portion of the drumstick or may be limited to the central portion of the drumstick. An axial bore may be formed in the invention regardless of material of fabrication. The sheath-type, which slips onto a traditional cylindrical drumstick, may be open at both ends or closed at one end. The invention may be practiced regardless of the tip or tips affixed to either or both ends of the drumstick. A retractable stick having alternative brush or tip ends may be inserted within the axial bore of the invention. The invention describes the device and how to make and use it.

25 Claims, 5 Drawing Sheets

3
10
18
18
3
12
12
3
7a
7a
14
16

7b
7b

MULTIFACETED DRUMSTICK

BACKGROUND—FIELD OF INVENTION

The present invention relates to drumsticks and more particularly to a unique grip for drumsticks.

BACKGROUND—DESCRIPTION OF PRIOR ART

Drumsticks for playing percussion instruments, such as drums and cymbals, are well known. In the prior art, designs for drumsticks always include a cylindrical handle portion, a striking head portion at the first end of the drumstick and a butt end at the second end of the drumstick, which may also be used for striking. While over the years novel adaptations for the head and butt ends have been developed, the basic configuration of the cylindrical handle, and its inherent shortcomings, remains unchanged.

To fully appreciate the improvement of this invention over the prior art, one must understand how drumsticks are used. Proper positioning of the sticks is taught by either of two (2) techniques. The sticks must be grasped near the balance, also known as the fulcrum, of the stick, (1) either between the thumb and forefinger or (2) between the thumb, forefinger and middle finger. Either of these two techniques permits the sticks to bound freely by somewhat pivotal movement under the control of the fingers. This point of balance or fulcrum cannot be varied without destroying the control of the stick.

The problem with the traditional cylindrical drumstick is that it is smooth and musicians often find it difficult to hold the stick for long periods of time without squeezing tightly on the stick. So, to accommodate for the need to hold on to the stick as the muscles start to fatigue, percussionists frequently alter the manner in which the stick is played. As the playing continues, rather than just using the fingers to control the stick, the drummer begins to use the wrist, forearm, and even the neck and shoulder in an attempt to hold the stick and continue to play as the muscle is experiencing weariness. This results in many physical problems. It is very common for percussionists to develop blisters to the hand from the increased friction as the grip tightens. In addition, physicians and orthopedic therapists are reporting muscle spasms and carpal tunnel syndrome as being frequent maladies secondary to the playing of percussion instruments.

Carpal tunnel syndrome is a painful disorder which is classified as one of the cumulative trauma disorders which make up over two-thirds of workplace injuries. Tasks with high repetitive wrist and finger movements and tasks that cause the wrist to be held at an angle or in an unnatural position generally cause carpal tunnel syndrome. Repetitive motion, forceful actions, rapid movement and stress are the four greatest contributors to carpal tunnel syndrome. And, all four contributors are present with traditional cylindrical drumsticks.

Yet even with this growing awareness of injury caused by playing drums with traditional cylindrical drumsticks, percussionists still lack a stick that has a grip which will reduce or alleviate pressure-causing injury.

The cylindrical nature of the traditional drumstick presents other problems as well. The bane of music teachers and music conductors everywhere is that drumsticks slip from the hands of the drummers and frequently fall, bounce, and roll across on the floor. Clearly, this is a highly undesirable characteristic of the traditional cylindrical drumstick.

An attempt to improve the hand-gripping surface of a traditional drumstick was set forth in U.S. Pat. No. 4,462,298 issued to Heiskell in 1984. This patent describes a drumstick having a cylindrical handle portion, which has been sanded to produce between 177 to 635 minute circumferentially extending scratches per inch, the scratches being from 0.001 to 0.002 inches in depth. The invention goes on to describe this as a relatively even surfaced handle portion. While this invention attempts to solve the problem of slippage, its application is undoubtedly marginal since in the fourteen years since the patent issued, the invention has not met with commercial success. In addition, the invention does not even attempt to address the injury-related problems such as carpal tunnel syndrome.

Another patent describes a bundle of sticks creating a stick type of drumstick as set forth in U.S. Pat. No. 4,535,671 issued to Stromberg in 1985. This is an entirely different, non-traditional type of stick, actually comprised of a bundle of small sticks or dowels, which are constrained by a rubber or plastic band. The invention teaches a new percussive instrument having unique tonal qualities. While patent '671 does describe a hexagonal cross-sectional shape formed, de facto, within the handle when the sticks are wrapped together, nevertheless, this stick-bundle form of a drumstick could never achieve the traditional sound and tonal qualities of a solid cylindrical piece of wood. Therefore, this invention, too, is extremely limited in its application and commercial success since the traditional cylindrical drumstick is still the preferred tonal quality of drummers worldwide.

None of the inventions and patents describes novel the invention as claimed in this disclosure. It is obvious that a clear need exists for a traditional drumstick having a means for gripping which not only facilitates the reduction of injury secondary to percussive arts, but also provides an efficient, simple and cost-effective means for improving the drumstick art. To this end, the teachings of the present invention embraces and finally addresses this long-standing and unmet need.

SUMMARY OF THE INVENTION

It is the object of this invention to provide a grip for a traditional drumstick which overcomes the drawbacks of the prior art. Further the disclosure will describe a method for making and using the grip for a traditional drumstick.

The apparatus and method of this invention have several features, no single one of which is solely responsible for its desirable attributes. Without limiting the scope of this invention as expressed by the claims which follow, its more prominent features will now be discussed briefly. After considering this discussion, and particularly after reading the section entitled "DETAILED DESCRIPTION OF THE PREFERRED EMBODIMENT," one will understand how the features of this invention provide its benefits and advantages.

More particularly, the invention provides an improved hand-gripping surface which may be utilized with any cylindrical drumstick regardless of its fabrication, whether wood, plastic, metal or any other substance or composition and regardless of whether there is a traditional tip, novel tip, brush, mallet, or other mean for striking at either the head end or the butt end. Additionally, several other objectives and advantages of the present invention are as discussed in the following paragraphs.

The first feature of the invention is that it relieves pressure on the wrist, forearm, bicep, shoulder and neck. When a drummer uses the drumstick of this invention, the wrist is turned down completely and remains parallel to the playing surface of the drum. This causes the blow from the stroke to be equally distributed throughout the whole wrist. The invention avoids awkward wrist angles and therefore reduces pressure on the tissues within the carpal tunnel and adjacent thereto.

The second feature of the invention is that it teaches student drummers proper technique. The original grip of this invention, particularly the six-sided grip (Hexagrip™) and the eight-sided grip (Octagrip™) is designed so that the placement of the fingers is exactly correct. With this uniquely constructed grip, the longitudinal facets upon the handle surface of a drumstick fit perfectly in the grooves of the index finger and thumb. The stick is now easily and comfortably held correctly.

The third feature of the invention is that it improves an experienced drummer's technique. Because the fingers are correctly placed, drummers with good techniques will improve dramatically. Drummers with poor techniques will now be forced to hold the stick correctly and automatically advance their playing skills. Even professionals, who have eroded techniques due to the inferior nature of traditional cylindrical drumsticks, will play better when using this invention. Since the art of drumming is largely in the fingers and the wrist, having good control and placement such as that experienced from the novel grip of this invention provides excellent technique for all drummers.

A fourth feature of this novel invention is that even with long playing, no blisters develop. Because the faceted grip is designed to fit between the grooves of the fingers and the hand, there is less spinning of the stick. This means less friction for the player and that equals fewer blisters during long-playing sessions.

The fifth feature of this novel invention is that the grip minimizes the dropping of the stick. Now that this drumstick is held correctly and is ultimately easier to hold, the drummer has more control that in turn avoids dropping the stick.

The sixth feature of the invention is that the cylindrical surface is replaced with a cylindrical surface having a grip, which is formed from a plurality of longitudinal facets. This will minimize the rolling as in a traditional cylindrical stick. The stick with the novel grip will now stay in place.

The seventh feature of the invention is an increase in the stamina for the percussion player utilizing the invention. Fatigue is common for a drummer utilizing traditional sticks. This is because the drummer tends to squeeze harder and harder as he or she plays. However, with the grip in place, fatigue in the forearm is virtually eliminated. The facets, which provide a plurality of straight edges, fit naturally into the grooves of the hand and fingers. This configuration of facets upon the cylindrical drumstick creates the perfect fulcrum without having to bear down or squeeze the drumstick as required with a traditional cylindrical stick. With less stress on the muscles, the forearm, bicep, back, neck and shoulder, drummers can relax during playing sessions and avoid tightening or spasm of the muscle. The drummer can play longer sets with improved stamina.

The eighth feature of the invention is that various embodiments permit flexibility to fit all players. With every hand being unique in size and strength, it is necessary to have different-sided shapes to fit everyone's hands. Therefore the invention can be practiced with from one to twenty-four facets. It is anticipated that the embodiments having eight or more facets will be better for children and adult players with small hands. While the embodiments having eight or fewer facets will be better for adults with larger hands. The unique grip, available with a varied number of facets will assure that there will be a stick suitable for any person.

The ninth feature of the invention is the advantageous placement for rim shots when utilizing the invention. The invention allows the player to hold the stick flatly and firmly against the head so that the identical sound produced by such a rim shot is reproducible each time the stick is struck. This is a great advantage over traditional round sticks wherein the sound differs and varies with each rim shot.

Furthermore, the disclosure which is the subject of this invention, will describe in detail how the device is made to enable one skilled in the art to practice the invention.

In its preferred form the drumstick grip of the invention is a cylindrical wood stick into which has been lathed one or a plurality of facets in the longitudinal plane. In a second embodiment, the grip is injection molded of rubber or other suitable material, the grip having one or a plurality of facets about the exterior surface in the longitudinal plane and having an axial bore extending through the interior length of the grip. The grip may be open at either one or both ends. The grip of the second embodiment is received onto the traditional cylindrical handle of any drumstick. In another less favored embodiment, the surface of the grip may be knurled.

BRIEF DESCRIPTION OF THE DRAWINGS

The preferred embodiment of this invention illustrating all its features will now be discussed in detail. The embodiment depicts a grip for a drumstick having one or a plurality of facets creating a shaped and faceted handle upon a traditional cylindrical surface. The accompanying drawings, which are for illustrative purposes only, include the following figures (Figs.), with like numerals indicating like parts.

DESCRIPTION OF THE PREFERRED EMBODIMENT

Figures 1A, 1B, 2, 3, 7A, 7B:
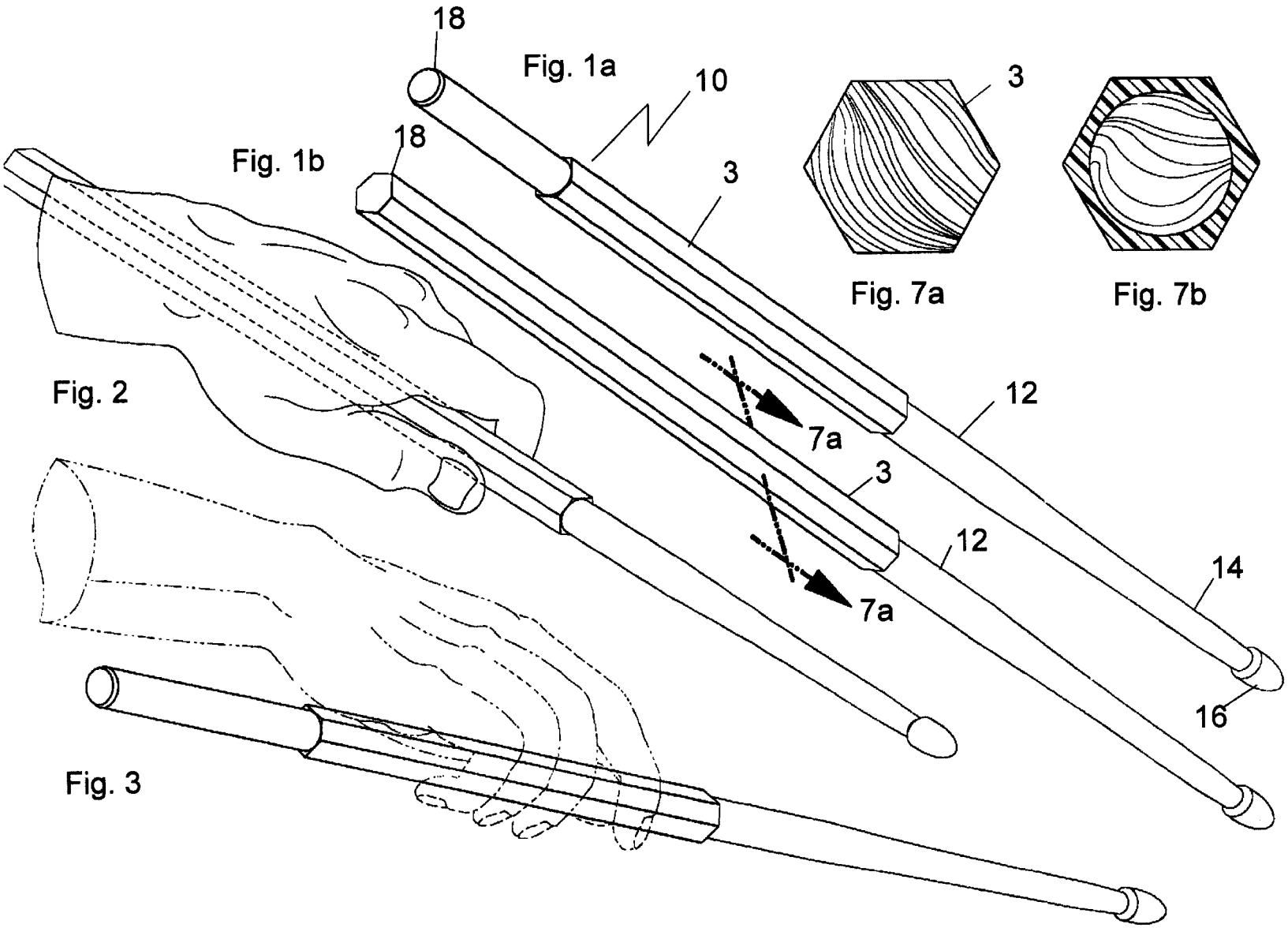
FIG. 1*a* is a perspective view of the embodiment of the invention.
FIG. 1*b* is a perspective view of a variation on the embodiment of the invention.
FIG. 2 is a perspective view of the invention as held by a user.
FIG. 3 is a perspective view of the invention as held by a user.
FIG. 7*a* is a cross-sectional view across lines 7*a*—7*a*.
FIG. 7*b* is a cross-sectional view across lines 7*b*—7*b*.

Referring first to FIG. 1*a*, there are depicted the general features of the preferred embodiment of the present invention which is a novel grip for a cylindrical drumstick indicated generally by the reference numeral 10. The drumstick has the usual elongated main body 12 fabricated in the usual manner of one piece of wood or other suitable material in accordance with the present invention. The elongated body 12 of the drumstick 10 is tapered toward the head end 14. The head end 14 is generally made to have a traditional tip 16 for striking a percussion instrument such as a drum or cymbal. In addition, the elongated body 12 of the drumstick 10 has a butt end 18. As further shown in FIG. 1*a*, the novel drumstick includes a one or plurality of facets 3 along the longitudinal axis. The facets 3 have been lathed into the cylindrical surface of the single piece of wood to form the new invention, a traditional cylindrical drumstick having a means for gripping.

Likewise, FIG. 1*b*, depicts an alternative form of the novel grip of this invention wherein the lathed facets 3 extend longitudinally from the elongated body 12 to the butt end 18 of the drumstick. Taking a cross-sectional cut along line 7*a*—7*a* of the drumstick as shown in FIGS. 1*b* and 7*a*, one would see the facets 3 which are integral to practice this invention. While the number of facets may vary from one to twenty-four depending upon personal preference, nevertheless, one or more facets must be present to provide the novel means for gripping the drumstick.

Figures 1C, 1D, 1E, 6:
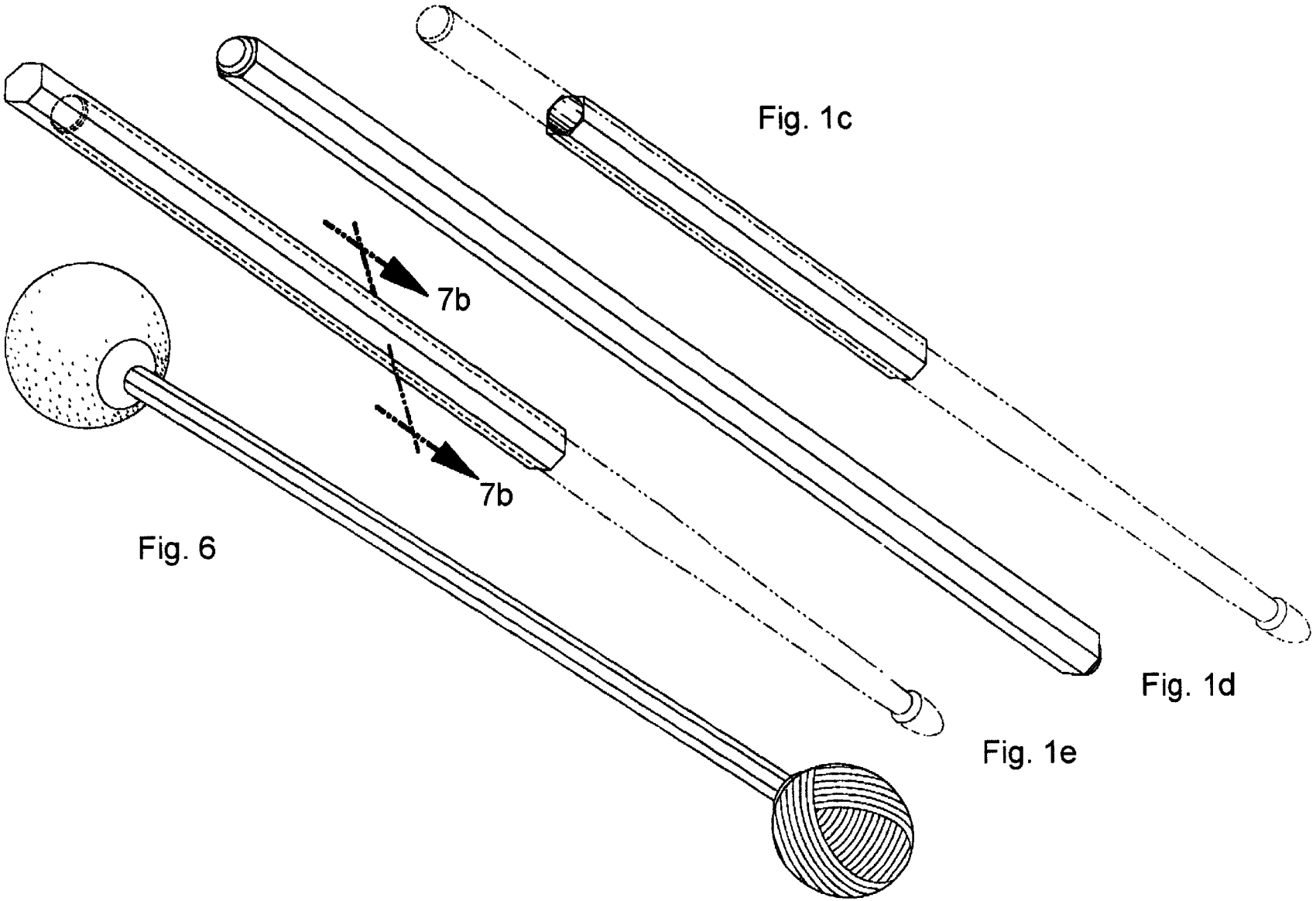
FIG. 1*c* is a perspective view of an alternative embodiment of the invention.
FIG. 1*d* is a perspective view of a variation on the embodiments of the invention.
FIG. 1*e* is a perspective view of a second variation on the alternative embodiment of the invention.
FIG. 6 is a perspective view of the invention having alternative head and butt adaptations at either end of the drumstick.

An alternative embodiment of the drumstick grip forming the basis of the invention is generally set forth in FIGS. 1*c*, 1*d*, and 1*e*. In this embodiment, the drumstick grip is fabricated of rubber, plastic, nylon or other suitable material. The grip is preferably injection molded to create a sleeve having an axial bore and having on its exterior surface one or a plurality of facets in the longitudinal axis as described above. The axial bore receives a standard cylindrical drumstick therein.

This embodiment, as with the preferred embodiment, must have one or a plurality of facets 3 as the faceted surface is integral to practice this invention. While the number of facets may vary from one to twenty-four depending upon personal preference, nevertheless, one or more facets must be present to provide the novel means for gripping the drumstick.

It is irrelevant to the practice of the alternative embodiment of this invention whether the sleeve forming the drumstick grip is open at only one end as shown in FIG 1*e* or both ends as shown in, for example, FIG. 1*c*. Furthermore, the lengths of the longitudinal facets are irrelevant to the practice of either embodiment of the invention. The facets may extend from the butt end to about the middle of the drumstick as shown in FIGS. 1*b* and 1*e*. Or, the facets may extend through the approximate center one-third of the drumstick as shown in FIGS. 1*a* and 1*c*. Or, the facets may extend the entire length of the drumstick as suggested in FIG. 1*d* and FIG. 6.

Figures 7C, 8, 9, 10, 11:
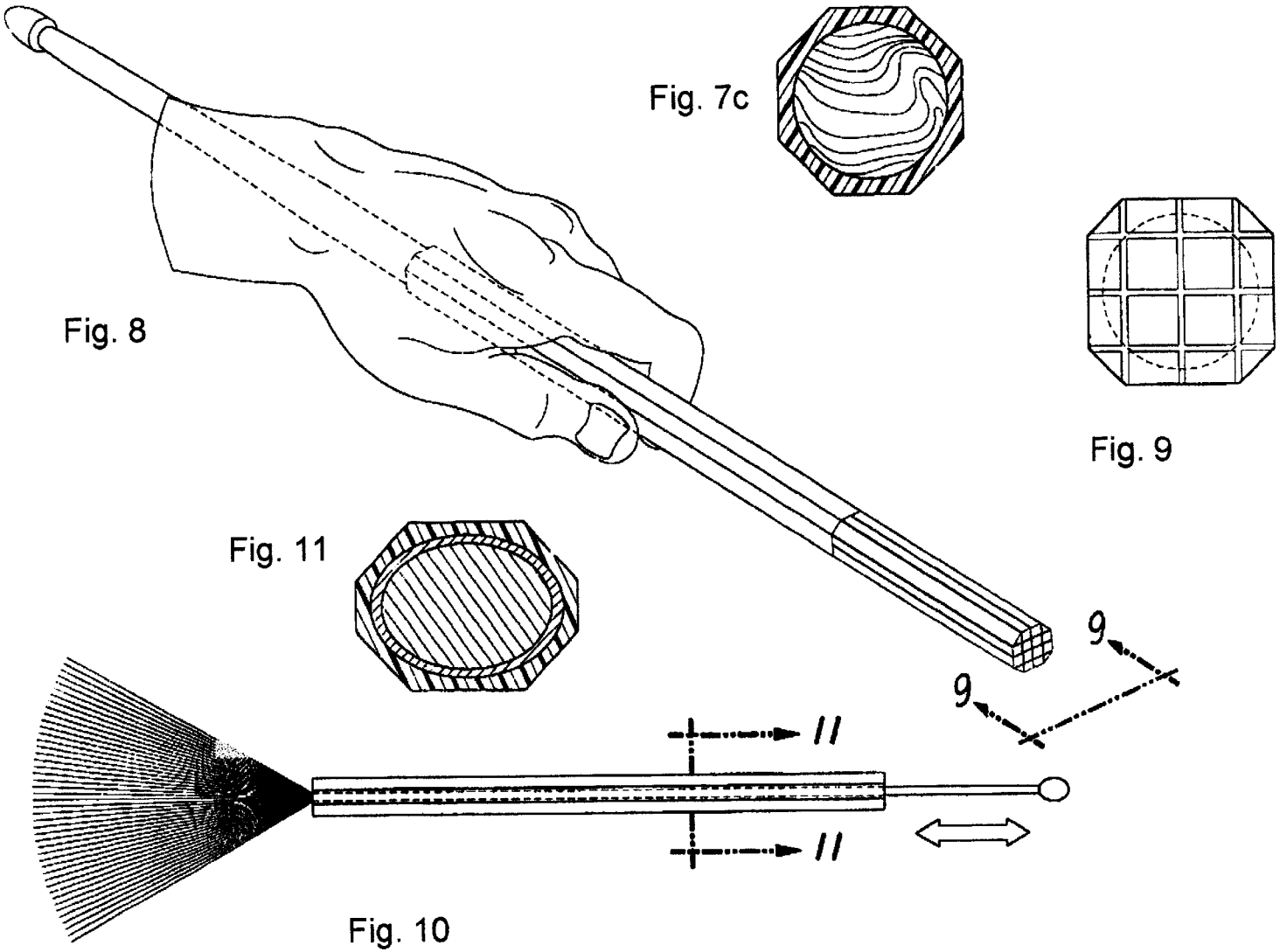
FIG. 7*c* is a cross-sectional view depicting the invention having eight facets.
FIG. 8 is a perspective view of the invention having a plurality of cuts at the butt end of the preferred invention.
FIG. 9 is a view across line 9—9.
FIG. 10 is a perspective view of the invention having within its longitudinal bore a movable brush at the head end and having a unique nylon drumstick tip at the butt end.
FIG. 11 is a cross-sectional view across line 11—11.
Figure 13:
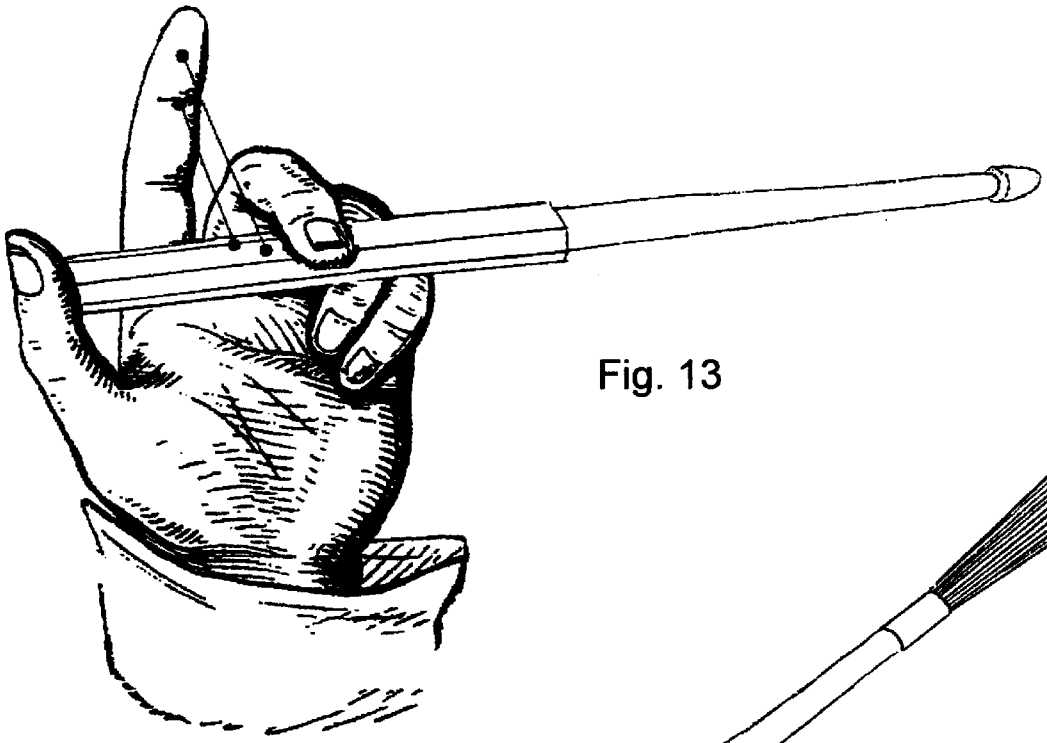
FIG. 13 depicts the finger placement in a traditional grip.
Figure 12:
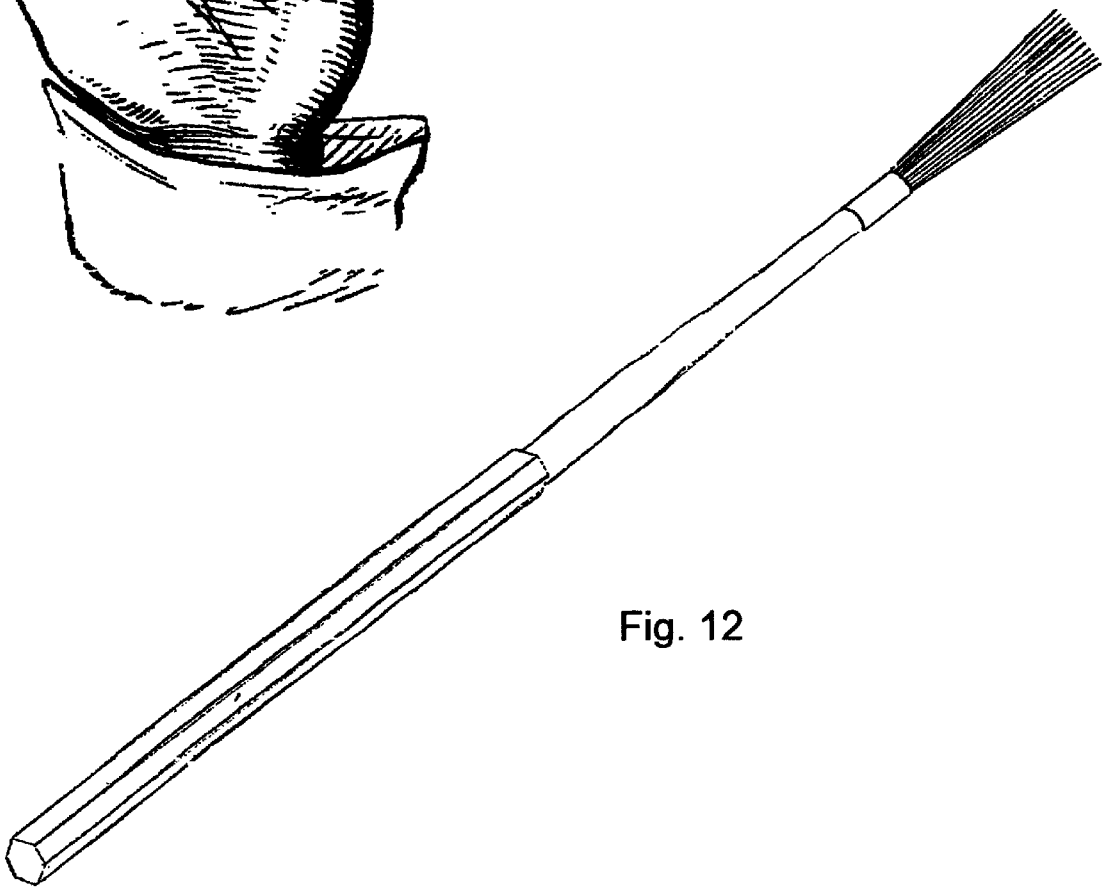
FIG. 12 depicts an alternative tip end.

Furthermore, the invention may be practiced with any adaptation at the head end and/or the butt end. Suggestions, which are not intended to be a limitation in scope, are shown as to tips that may be used while still practicing the invention. In addition to the standard tips as shown in FIGS. 1–5, FIG. 6 suggests differing mallets, which may be affixed at either end. Furthermore, FIG. 9 shows a plurality of horizontal and vertical cuts into the butt end of the faceted wooden or other material drumstick stick. FIG. 10 shows the axial bore of the faceted invention fabricated of wood, rubber, or other suitable material receiving a retractable stick which is depicted as having a brush at one end and tip at the other end for playing the percussion instrument. It is preferred that the tip end in the embodiment of FIG. 10 be made of nylon but other suitable materials may be used as well. Finally, FIG. 12 depicts another preferred nylon tip which may be adapted to fit the invention or a standard cylindrical drumstick and may also be made of other suitable materials.

Figure 4:
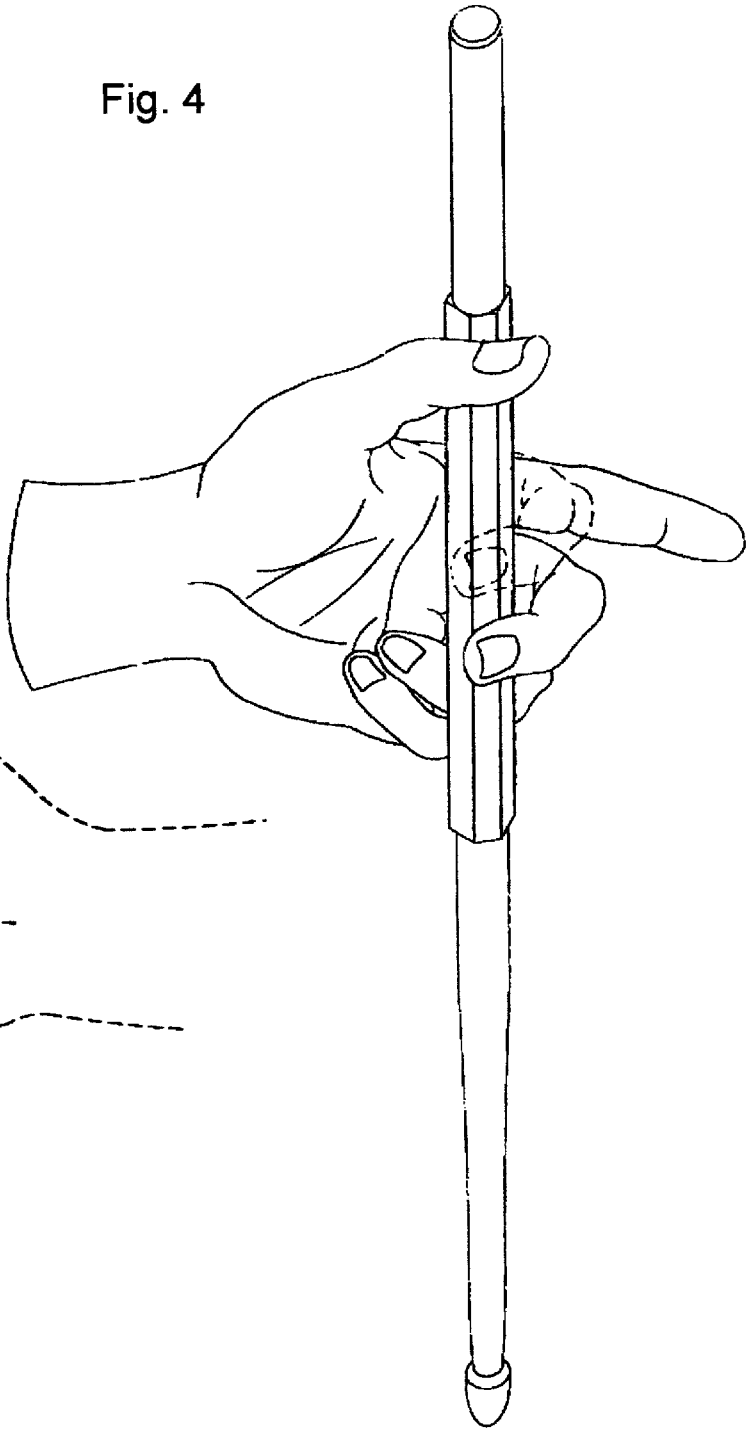
FIG. 4 is a perspective view showing the proper placement of the user's fingers on the invention in a traditional grip.
Figure 5:
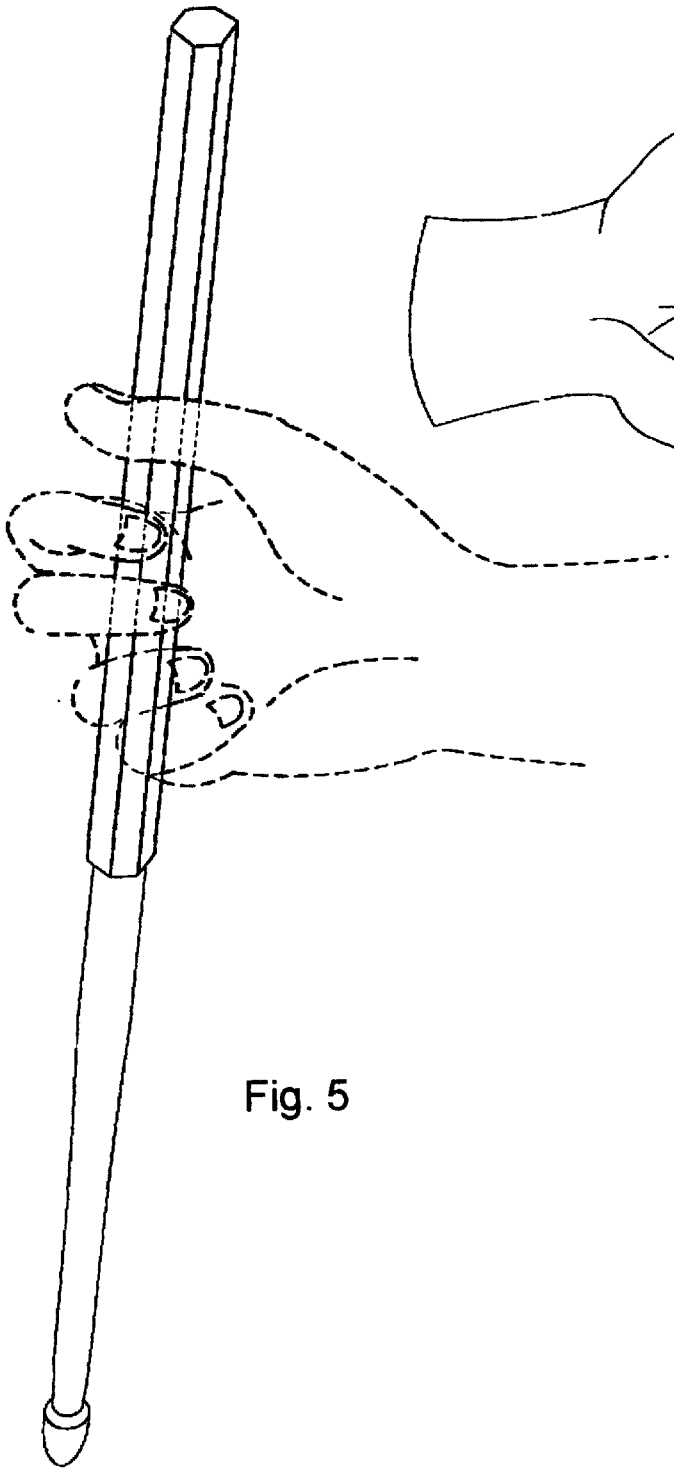
FIG. 5 is a perspective view of the fingers properly placed on the invention in a traditional grip.

The use of this novel invention is shown in FIGS. 2 through 5. The facets provide a means for properly and comfortably gripping the drumstick. Specifically, FIG. 4 depicts how the first and middle fingers are naturally placed upon the first and second or third facets. When a percussionist begins to play, the facets provide a means for gripping the stick with the fingers and holding the stick with the thumb. The user is automatically forced to hold the drumstick in the proper manner. This will reduce stress and tension on the fingers, wrist, forearm, neck and shoulder during playing sessions.

This invention as described thereby solves a longstanding and unmet need for an improved drumstick handle which improves performance, reduces stress and muscle tension and helps to eliminate their related injuries.

SCOPE OF THE INVENTION

The above-presented description of the best mode contemplated of carrying out the present invention and of the manner and process with making and using it is in such a full, clear, concise and exact terms as to enable to any person skilled in the art to which it pertains to make and use this invention.

This invention is however, susceptible to modifications and alternate constructions from that disclosed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims which particularly point out and distinctly claim the subject matter of the invention:

We claim:

1. A drumstick for striking a percussion instrument having, an elongated cylindrical body tapered toward a head, a butt end, said drumstick having an external surface, said external surface having from 5 to 18 facets upon said external surface, said facets being lathed into said cylindrical body, wherein said facets are used for gripping the surface of said drumstick.

2. A drumstick for striking a percussion instrument having a sleeve, said sleeve having an external surface with 5 to 18 longitudinally formed facets upon said external surface, said sleeve securely positioned over said drumstick, said drumstick having an elongated cylindrical body, a head end, a butt end, and wherein said facets are used for gripping the surface of said drumstick.

3. A drumstick for striking a percussion instrument having a hollow elongated cylindrical body said body having an external surface, and having from 5 to 18 facets formed upon said external surface, said drumstick having a retractable tip end and a retractable butt end, wherein said facets are used for gripping the surface of said drumstick.

4. A drumstick for striking a percussion instrument as set forth in claim 1 having a mallet.

5. A drumstick for striking a percussion instrument as set forth in claim 2 having a mallet.

6. A drumstick for striking a percussion instrument as set forth in claim 1 having a brush.

7. A drumstick for striking a percussion instrument as set forth in claim 2 having a brush.

8. A drumstick for striking a percussion instrument as set forth in claim 1 having a plurality of horizontal and vertical cuts in said butt end.

9. A drumstick for striking a percussion instrument as set forth in claim 2 having a plurality of horizontal and vertical cuts in said butt end.

10. A drumstick for striking a percussion instrument as set forth in claim 1 having a traditional drum tip.

11. A drumstick for striking a percussion instrument as set forth in claim 2 having a traditional drum tip.

12. A drumstick for striking a percussion instrument as set forth in claim 3 having a mallet.

13. A drumstick for striking a percussion instrument as set forth in claim 3 having a brush.

14. A drumstick for striking a percussion instrument as set forth in claim 3 having a plurality of cuts at said butt end of said drumstick.

15. A drumstick for striking a percussion instrument as set forth in claim 3 having a traditional drum tip.

16. A drumstick for striking a percussion instrument as set forth in claim 1 having said facets molded to said cylindrical body.

17. A drumstick for striking a percussion instrument as set forth in claim 1 having a striking device at said head end.

18. A drumstick for striking a percussion instrument as set forth in claim 2 having a striking device at said head end.

19. A drumstick for striking a percussion instrument as set forth in claim 1 having a striking device at said butt end.

20. A drumstick for striking a percussion instrument as set forth in claim 2 having a striking device at said butt end.

21. A drumstick for striking a percussion instrument as set forth in claim 1 having a striking device at both said head end and said butt end.

22. A drumstick for striking a percussion instrument as set forth in claim 2 having a striking device at both said head end and said butt end.

23. A drumstick for striking a percussion instrument as set forth in claim 3 having a striking device at both said head end and said butt end.

24. A drumstick for striking a percussion instrument as set forth in claim 1 said elongated body being tapered at both said head end and said butt end.

25. A drumstick for striking a percussion instrument as set forth in claim 2 said elongated body being a tapered at both said head end and said butt end.

* * * * *